US005418516A

United States Patent [19]

Oh

[11] Patent Number: 5,418,516

[45] Date of Patent: May 23, 1995

[54] SURGE RESITOR FUSE

[75] Inventor: Seibang Oh, Elk Grove Village, Ill.

[73] Assignee: Littlefuse, Inc., Des Plaines, Ill.

[21] Appl. No.: 149,312

[22] Filed: Nov. 9, 1993

[51] Int. Cl.[6] ..... H01C 7/10

[52] U.S. Cl. ..... 338/21

[58] Field of Search ..... 338/21; 361/117, 118, 361/119, 127

[56] References Cited

U.S. PATENT DOCUMENTS 4,866,561 9/1989 Dorival ..... 361/119

*Primary Examiner*—Marvin M. Lateef

*Attorney, Agent, or Firm*—Wallenstein & Wagner Ltd.

[57] ABSTRACT

A surge resistor fuse having an exposed pair of terminals for connection to an external circuit comprising an insulating housing having an exterior and an interior, a resistor element designed to interrupt the circuit when a surge of current passing through the resistor element exceeds a given energy level, and a fusing element designed to fuse under short circuit conditions and certain prolonged overload conditions, wherein the resisting element and the fusing element are connected in series and are mounted within a common enclosure.

11 Claims, 1 Drawing Sheet

SURGE RESITOR FUSE

DESCRIPTION

1. Technical Field of the Invention

This invention has its most important, but not only, application to the field of fuses designed to protect phone lines against surges caused primarily by lightning.

2. Background of the Invention

Lighting striking phones lines is a common problem. Lightning strikes can cause current surges to be induced into circuits in telephone lines which can damage switching station and other equipment. The same is true under conditions referred to as power cross. Power cross occurs when a power line comes into physical and electrical contact with a telephone line which can also damage equipment from a power surge created in the telephone line. To minimize damage from such conditions, elements referred to as wire-wound resistors are placed in the line to absorb some of the energy of a power surge caused by these conditions. The surge resistor fuse is constructed of two major components: a wire-wound resistor and a thermal fuse. The wire-wound resistor will melt to open the circuit under some unduly severe energy surge conditions. The thermal fuse protects the circuit under more modest overload conditions caused by short circuit or prolonged overloads. The use of a separate resistor and a thermal fuse requires greater space than if such elements were combined in a single housing, and the purchase of two separate elements which is more expensive than if both elements shared a common enclosure.

SUMMARY OF THE INVENTION

A broad aspect of the present invention comprises a resistor and fuse as described which share a common housing and connecting leads. In its more specific aspects, the invention includes the placement of the fuse element inside the body of the resistor. This makes the fuse much more compact and maximizes the desired heat transferring function of the resistor.

In accordance with another specific aspect of the invention, the surge resistor fuse of the present invention comprises a hollow insulating tube around which resistance wire is spirally wound or otherwise deposited, and the fuse element is a section of fuse wire forming a finger of solder extending axially inside the tube. The finger of solder occupies only a part of the volume of the insulating tube interior so that when the solder melts, it can quickly flow into the remaining space inside the tube to form a gap or discontinuity in the circuit involved.

Other aspects and advantages of the present invention will become apparent upon making reference to the specification, claims and drawings to follow.

DETAILED DESCRIPTION OF THE INVENTION

Figure 1:
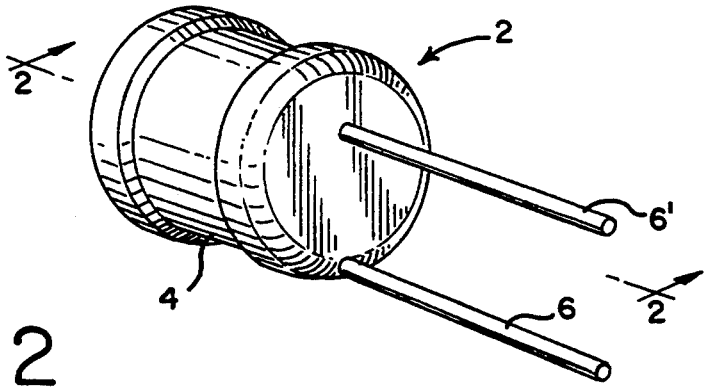
FIG. 1 is a perspective view of the surge resistor fuse of the present invention.

While this invention is susceptible of embodiment in many different forms, there is shown in the drawings and will herein be described in detail, a preferred embodiment of the invention with the understanding that the present disclosure is to be considered as an exemplification of the principles of the invention, and is not intended to limit the broad aspect of the invention to the embodiment illustrated.

The surge resistor fuse of the invention illustrated in FIG. 1 and indicated by reference numeral 2 includes an outer generally cylindrically-shaped enclosure 4 from which extends a pair of connecting leads 6—6'. The leads are shown extending from one end of the enclosure. The enclosure 4 is shown closely enveloping the resistor and fuse element to be described to preferably be arranged in a manner which makes a product of minimum overall size without adversely affecting the desired functions of these two elements. The enclosure 4 has a layer of insulating material which could be molded over the resistor portions of the fuse to be described, or more preferably, by dipping the resistor and fuse element in a body of the desired material to form a coating thereover which seals the interior from the external elements.

The resistor comprises a hollow insulating tube 12, preferably made from a ceramic material which is well-known in the art. The size of the tube will vary with the capacity of the resistor. The tube 12 has a first end 14 and a second end 16.

Figure 2:
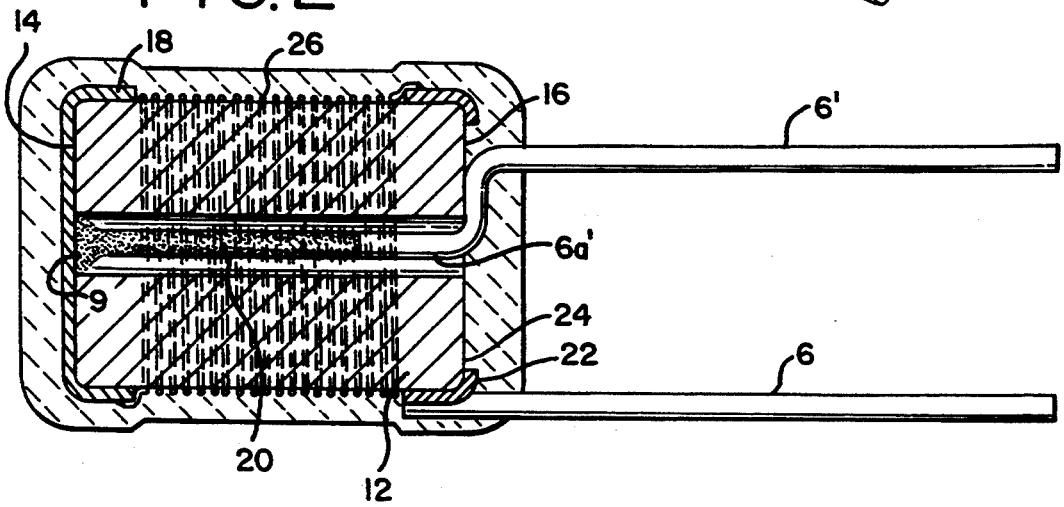
FIG. 2 is a cross-sectional view of the surge resistor fuse of the present invention.
Figure 3:
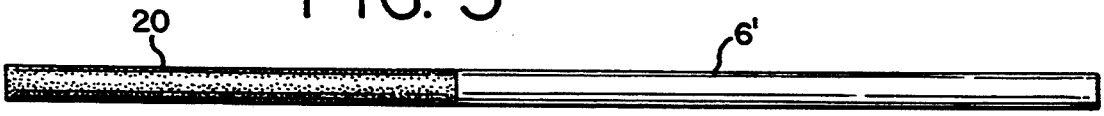
FIG. 3 is an enlarged view of the connection between the solder finger and the first lead wire.

At the first end 14 of the tube 12 is a first conductive end cap 18, preferably made of silver-plated stainless steel. The first end cap 18 encloses the first end 14 of the tube 12, and is anchored to the tube 12 by an interference press-fit. Attached to the inner center of the first end cap 18 and extending axially through the tube 12 is a solder finger 20. The solder finger 20 is soldered to the inside of the first end cap 18 at 9 (FIG. 2) as by heating the first end cap.

At the second end 16 of the tube 12 is a second end cap 22. The second end cap 22 has an opening 24 in the center. The second end cap 22, which is preferably made of stainless steel, is attached to the tube 12 by an interference press-fit.

Spirally wound around the tube 12 is a resistance wire 26 having the resistor referred to. The diameter of the wire 26 will vary depending on the value and surge capacity desired. The distance between turns of the wire 26 should be maximized for best performance. The ends of the resistor wire 26 are welded to the first end cap 18 and the second end cap 22, respectively. The surge capacity of the wire 26 depends in part on the cross-sectional area of the wire. The wire 26 acts to absorb energy from the current pulse created by any power surge.

Figure 4:
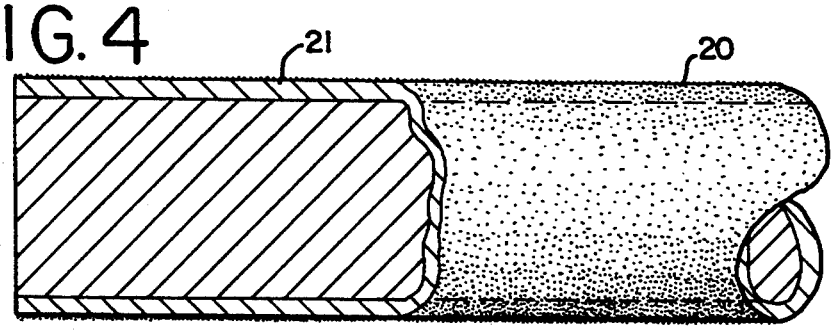
FIG. 4 is a further enlarged view of FIG. 3 showing the details of the coating of the solder finger and first lead wire.

Extending axially through the tube 12 is a length of fuse wire, preferably of a size less than the internal diameter of the tube. The fuse wire may be a finger of solder 20 coated, if necessary, with a material which prevents oxidation of the solder. This coating is shown in FIG. 4 where it is identified by reference numeral 21. It may be made of a material commonly referred to as a "hot melt adhesive." The finger of solder 20 is soldered to the inside of the first end cap 18 at 9 (FIG. 2) as by heating the end cap to melt the end of the solder finger 20. The solder finger forms an extension of the straight inner end portion 6a' of the lead 6'. The lead 6' bends sharply around the end face of the tube 12 so that the end cap 18 is locked upon the end 14 of the tube 12. The lead then extends axially through the end cap opening 24. The other lead 6 is a straight lead welded to the outer face of end cap 22.

The following specifications are applicable to a resistor and fuse element like that shown in the drawings designed to have a cold resistance value of 82.5 ohms:

(1) The fuse opens under the following conditions:
  (a) a prolonged overload of 350 ma. flowing for a maximum of 3 minutes to deliver 10 watts of power to the resistor;
  (b) a prolonged overload of 780 ma. flowing for a maximum of 30 seconds to deliver 50 watts of power to the resistor.

(2) The fuse also opens immediately at 600 volts and 300 amps.

(3) The fuse will withstand without blowing a power surge induced by lightning, produces a current pulse having an energy content no greater than that present in a waveform reaching 100 amps in less than 10 microseconds and decreasing to zero at a rate where the current decreases to 50 amps in 1,000 microseconds.

(4) Enclosure 4 specifications:
  Axial length of enclosure—0.5";
  outer diameter of enclosure—0.330";
  inner diameter of enclosure—0.050";
  length of enclosure—0.5";
  coating: ceramic purchased from Aremco Products under Order Nos. 538 and 538T, respectively (5) Lead specifications:
  external lead spacing—0.200";
  lead diameter—0.020";

(6) Solder fuse specifications:
  97.5% lead, 2.5% silver eutectic mix (melts at 581° F.);
  purchased from Kester Solder Co. (address);
  solder wire length—0.425";
  solder wire circumference—0.025";
  thickness of hot melt coating 0.003";
  hot melt coating purchased from 3M under Order No. P/N P6-3779-3

(7) Resistor specifications:
  diameter—0.0035";
  resistor wire material—Stablohm 800 (75% nickel, 20% chromium and balance is aluminum and copper);
  wire resistors—65.30 ohms/ft.
  winding spacing—0.0035"
  number of turns—20.5

(8) Insulating tube specifications:
  tube material—Steatite L3
  tube outer diameter—0.235"
  tube inner diameter—0.05"
  tube length—0.370"

Under the fuse conditions described above under (1), (2) and (3), the surge resistor fuse acts as follows. Under the conditions of 1(*a*) and 1(*b*), the resistor wire 26 heats and the solder finger 20 melts, thus opening the fuse. Under the conditions of (2), the wire 26 around the tube 12 melts and opens like a fast-acting fuse, thus opening the circuit. Finally, under the conditions listed in (3), the resistance wire 26 limits current through the surge resistor fuse, thus allowing the solder finger 20 to remain intact.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. A combination surge resistor and fuse comprising:
  an insulating enclosure having an exterior and an interior;
  an exposed pair of terminals assembled at the outside of said enclosure;
  a surge resistor element inside said enclosure designed to interrupt the circuit when a surge of current passing through said resistor element exceeds a given energy level; and
  a fuse element inside said enclosure designed to fuse under short circuit conditions and certain prolonged overload conditions, said surge resistor element being in series with said fusing element and pair of terminals.

2. The combination surge resistor and fuse of claim 1 wherein said insulating tube is a hollow cylinder.

3. The combination surge resistor of claim 1 wherein said insulating tube is made of ceramic.

4. The combination surge resistor and fuse of claim 1 wherein said fuse element comprises a finger of meltable material.

5. The combination surge resistor and fuse of claim 1 wherein said fuse element is a finger of meltable material inside said insulating tube.

6. A combination surge resistor and fuse comprising:
  a hollow insulating tube having a first end and a second end;
  a first end cap enclosing said first end of said hollow tube;
  a finger of meltable material which melts when the fuse is to blow under certain prolonged overload conditions, located axially within said hollow tube and attached to said first end cap;
  a first lead attached to said solder finger;
  a second end cap having an opening adapted to receive said first lead therethrough enclosing said second end of said tube;
  a resistor-forming wire would around said hollow tube and connected to said first and second end caps; and
  a second lead attached to said second end cap.

7. The combination surge resistor and fuse of claim 6 further comprising a coating encapsulating said fuse and surge resistor.

8. A combination surge resistor and fuse comprising:
  an insulating enclosure having an exterior and an interior;
  an exposed pair of terminals assembled at the outside of said enclosure;
  a surge resistor element inside said enclosure designed to interrupt the circuit when a surge of current passing through said resistor element exceeds a given energy level;
  a fuse element inside said enclosure designed to fuse under short circuit conditions and certain prolonged overload conditions, said surge resistor element being in series with said fusing element and said pair of terminals, said surge resistor element being disposed around said fuse element.

9. The combination surge resistor and fuse of claim 8 wherein said surge resistor element is comprised of a spiral winding of conductive material.

10. The combination surge resistor of claim 9 wherein there is provided an insulating tube for supporting said spiral winding.

11. The combination surge resistor and fuse of claim 8 wherein there is space in said insulating tube for said meltable material to flow when said material melts.

* * * * *

UNITED STATES PATENT AND TRADEMARK OFFICE

CERTIFICATE OF CORRECTION

PATENT NO. : 5,418,516

DATED : May 23, 1995

INVENTOR(S) : Seibang Oh

It is certified that error appears in the above-indentified patent and that said Letters Patent is hereby corrected as shown below:

Title page, item [54] line 1, and column 1, line 1, delete "RESITOR" and --RESISTOR--; and
Item [73] Assignee, delete "Littlefuse" and insert --Littelfuse--.

Column 4, line 49, delete "would" and insert --wound--.

Signed and Sealed this

Fourteenth Day of November, 1995

*Attest:*

*Attesting Officer*

BRUCE LEHMAN

*Commissioner of Patents and Trademarks*